United States Patent [19]

Obermayer

[11] 4,291,654

[45] Sep. 29, 1981

[54] PULLBACK STARTER FOR INTERNAL COMBUSTION ENGINES

[75] Inventor: Alfred Obermayer, Lambach, Austria

[73] Assignee: Bombardier-Rotax Gesellschaft m.b.H., Gunskirchen, Austria

[21] Appl. No.: 91,511

[22] Filed: Nov. 5, 1979

[30] Foreign Application Priority Data

Dec. 4, 1978 [AT] Austria ..... 8625/78

[51] Int. Cl.[3] ..... F02N 1/00

[52] U.S. Cl. ..... 123/185 BA; 123/185 B; 123/185 R; 74/6

[58] Field of Search ..... 123/185 BA, 185 A, 185 B, 123/185 R, 185 BB; 74/6, 7 C

[56] References Cited

U.S. PATENT DOCUMENTS

| | | | |
|---|---|---|---|
| 2,278,547 | 4/1942 | Herrington | 123/185 BA |
| 3,081,759 | 3/1963 | Mauck et al. | 123/185 BA |
| 3,730,162 | 5/1973 | Murase | 123/185 BA |
| 3,871,350 | 3/1975 | Hamman | 123/185 BA |
| 4,127,098 | 11/1978 | Frers et al. | 123/185 A |

*Primary Examiner*—P. S. Lall
*Attorney, Agent, or Firm*—Kurt Kelman

[57] ABSTRACT

A rope drum is rotatably mounted on an axle, which is fixed in a frame. A rope is wound on said drum and adapted to be pulled from said drum so as to rotate the latter in a predetermined sense. A pullback spring tends to rotate said drum opposite to said predetermined sense. A one-way coupling element is pivoted to said drum on a pivotal axis that is parallel to the axis of said axle. The coupling element carries a first stop and is pivotally movable about said pivotal axis from an inner position to an outer position for one-way coupling engagement with a clutch member on an input shaft of an internal combustion engine, and back to said inner position. A locking member carries a second stop and is movable relative to said axle and mounted in said coupling element for rotation relative thereto about an axis of rotation to a locking position, in which said second stop cooperates with said axle to prevent an outward movement of said coupling element from said inner position to said outer position, and to a non-locking position of said locking member, in which said second stop is arranged to permit said outward movement and said locking member engages said coupling element in the sense of said outward movement. A constraining spring extends around and is rotatable about said axis and torsionally prestressed to be normally in frictional contact with said axle and has at one end a spring arm, which protrudes laterally from said axle and engages said locking member. Said constraining spring tends to move said locking member by means of said spring arm in the sense of said outward movement.

5 Claims, 3 Drawing Figures

PULLBACK STARTER FOR INTERNAL COMBUSTION ENGINES

Figure 1:
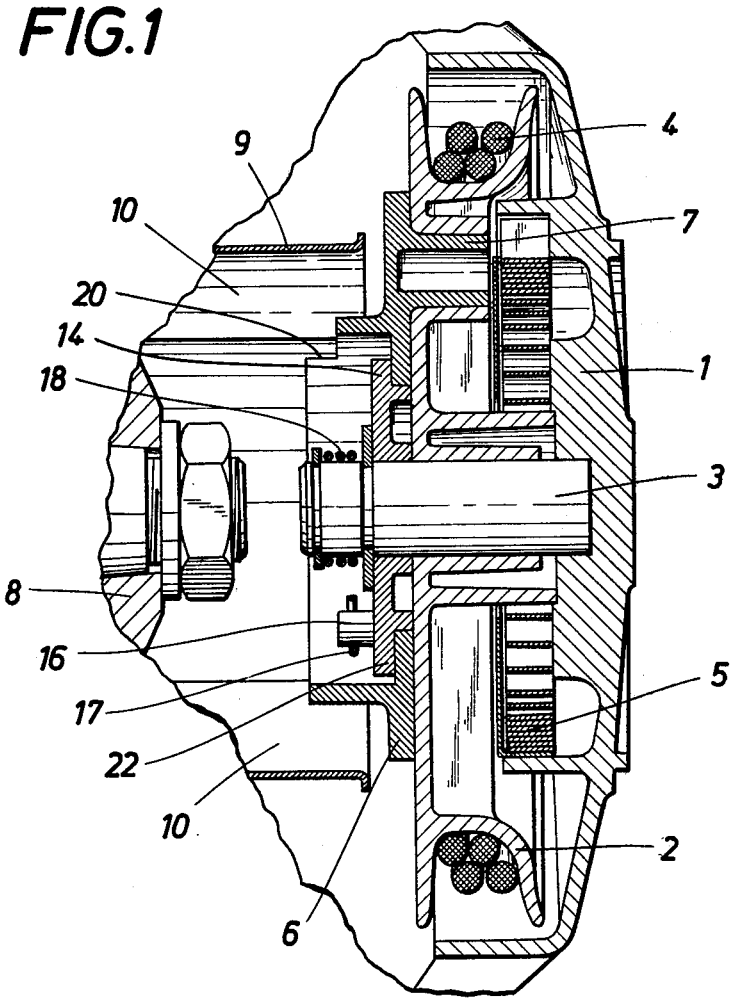

This invention relates to a pullback starter for internal combustion engines, comprising a housing, a rope drum, which is rotatably mounted on an axle that is fixed to the housing, a rope which is wound on said drum and can be pulled to drive the drum against the force of a pullback spring, and a one-way coupling element, which is pivoted to the rope drum on an axis that is parallel to the axis of the axle and constitutes an engageable and disengageable clutch member of a clutch for connection to the input shaft of the internal combustion engine, which coupling element is pivotally movable inwardly and outwardly by a constraining member, which is capable of a frictionally braked rotation about the axis of said axle.

In a known pullback starter of that kind, disclosed in U.S. Pat. No. 3,730,162, the constraining member comprises a pin, which extends into a cam slot of the coupling element so that at the beginning of the rotation of the rope drum about the axle the coupling element is restrained by the pin of the frictionally braked constraining member, which is mounted on the non-rotatable axle for the rope drum. In that phase, the coupling element is swung out about an axis of rotation defined by the pin of the constraining member and engages the clutch member which is connected to the input shaft of the internal combustion engine. When that clutch has thus been engaged, the continued rotation of the rope drum during the continued pulling of the rope will be transmitted to the output shaft and the constraining member must then follow the rotation of the rope drum because the outward movement of the one-way coupling element is limited by a stop. This corotation is ensured in that the constraining member is mounted on the fixed axle by a friction coupling, which comprises a friction flange against which the constraining member is axially urged by a prestressed spring.

When the pullback spring which has been wound up as the rope was pulled imparts a reverse rotation to the rope drum so that the coupling element is moved in the opposite sense, the constraining pin extending into the slot of the coupling element initially constitutes a stationary pivot for the coupling element so that the latter is swung to its stop-defined initial position, in which the clutch is disengaged. Because the coupling element engaging the stop is restrained by the latter and by the pivot connecting the coupling element to the rope drum, the constraining member must necessarily move with the coupling element also in the opposite direction. As the clutch member connected to the input shaft overruns the rope-driven coupling element, that clutch member engages the coupling element at inclined surfaces which have such an inclination that the force applied to them causes the positive engagement to be eliminated so that the coupling element is swung in relative to the rope drum. This can easily be accomplished because the constraining member is rotatable.

To ensure that the coupling element cannot inadvertently move from its inner or disengaged position to its outer or engaged position under the influence of inevitable vibrations of the internal combustion engine, the coupling element is biased inwardly by a suitable spring. The known arrangement has the disadvantage that said spring must be rather strong if an inadvertent outward pivotal movement of the coupling element is to be reliably prevented. The use of a strong bias spring involves the need for a properly dimensioned spring for the friction coupling between the constraining member and the fixed axle because that friction coupling must reliably prevent a premature rotation of the constraining member. Besides, the fact that the constraining member is forced against a friction flange which is normal to the axis involves an expensive structure and an undesirably large overall height.

For this reason it is an object of the invention to avoid the above-mentioned disadvantages and to provide an improved pullback starter which is of the kind described first hereinbefore and comprises simple means for preventing an inadvertent outward movement of the coupling element. Besides, the constraining member for effecting the inward and outward movements of the coupling element and the means for mounting said constraining member should be as simple as possible.

This object is accomplished according to the invention in that the constraining member comprises a prestressed spring, which extends around the fixed axle and has a spring arm that protrudes from said fixed axle and engages a locking member, which is mounted on the coupling element for rotation between locking and non-locking positions and which comprises a locking stop which in the locking position is disposed in front of the fixed axle when seen in the direction of the outward pivotal movement of the coupling element whereas in the non-locking position the locking member engages a stop of the coupling element in the direction of its outward pivotal movement.

Because the constraining member does not act directly on the coupling element but acts on a locking member which is rotatably mounted in the coupling element, the locking member is held against rotation relative to the fixed axis by the frictionally braked constraining member mounted on the fixed axle and this is ensured even at the beginning of the rotation of the rope drum so that the locking member is then rotated relative to the coupling element, which rotates in unison with the rope drum. That relative rotation of the locking member is then used to lock or unlock the coupling element because the locking member carries a locking stop, which in the locking position is disposed in front of the fixed axle so that the coupling element cannot be swung out about its pivotal axis. To unlock the coupling element, the locking member must be rotated in the coupling element. Such rotation is effected by the constraining member in response to the actuation of the pullback starter. On the other hand, the constraining member prevents an inadvertent rotation in response to vibrations. As a result, the coupling element is reliably locked in its inner position, in which the clutch is disengaged, without need for an additional spring. To engage the clutch in response to an actuation of the starter, the locking member will engage a stop of the coupling element when the locking member has rotated relative to the coupling element as far as is required for unlocking. This engagement of the locking member with the stop of the coupling element establishes between the locking member and the coupling element a positive connection and thereafter the continued rotation of the rope drum causes the constraining member, which engages the locking member, to impart to the coupling element an outward pivotal movement for engaging the clutch. As the rotation of the rope drum is continued further, the constraining member rotates in unison with the rope drum because the outward movement of the coupling element is limited. During a reverse rotation of the rope drum, the movements are performed in the reverse sequence: The constraining member is relieved from the torque of the rope drum and restrains the locking member so that the latter is rotated in the opposite sense relative to the coupling element and swings the latter back to its inner or initial position. The constraining member is not moved by the locking member and the stop thereof until the locking member has performed a further movement relative to the coupling element. As a result, the locking stop of the locking member is swung to a position in front of the fixed axis, seen in the direction of the outward movement of the coupling element, before the locking member is non-rotatably connected to the coupling element.

It is apparent that the coupling element can be locked in a simple and reliable manner by a locking member which is rotatably mounted in the coupling element and that the use of a constraining member consisting of a prestressed spring which extends around the fixed axle provides a structure which is compact and does not interfere with the mounting and movement of the locking member because the axially acting spring and the friction flange are eliminated.

In accordance with a preferred feature of the invention the constraining member comprises a coil spring which is wound on the fixed axle and has a second spring arm, which protrudes from the fixed axle, and a stop that is carried by the coupling element cooperates with said second spring arm and tends to wind up the spring and defines the locking position. In that case the structure will be further simplified and an inadvertent rotation of the locking member out of its locking position will be even more reliably prevented. If appropriate springs have been provided and the locking member is subjected to vibrations tending to move the locking member in an unlocking sense, then the locking member will act on the coil spring arm in a winding-up sense so that the coil spring will be more tightly wound on the fixed axle. For this reason the constraining member cannot be rotated by the locking member when the latter is loaded in the unloading sense. On the other hand, when the starter is being actuated and the locking member rotates in unison with the rope drum after the coupling element has been swung out, the locking member will act on the spring arm in the unwinding sense so that the constraining spring can easily rotate on the fixed axle. With such a constraining member, the locking position assumed by the locking member during the reverse rotation imparted to the rope drum by the pullback spring must not be defined by a stop which acts on the locking member because the locking member would then exert on the spring arm a tension which would prevent a rotation of the constraining spring on the fixed axle. To avoid such self-locking action and to provide conditions which are favorable like those during the starting movement, the coupling element carries a stop which bears on the second spring arm in the spring-unwinding sense. That stop defines the locking member position because the locking member is held in position relative to the fixed axle only until the second spring arm is engaged by the stop carried by the coupling element. The use of a coil spring as a constraining member does not only prevent an inadvertent rotation of the locking member by forces acting on the locking member but locks also the constraining member against a vibration-induced rotation because vibrational forces will act only on the first convolutions of the coil spring rather than on its middle portion. As a result, the spring has a damping action, which prevents an inadvertent rotation of said spring.

According to a preferred feature of the invention, the locking member consists of a disc formed with a slot through which the fixed axle extends and which extends along an arc of a circle which is centered on the pivotal axis of the coupling element when the locking member is in its non-locking position, which is defined by a stop, and one end of said slot is arcuate and centered on the axis of rotation of the locking member. The ends of the slot limit the angular movement of the coupling element. The use of a locking member consisting of a disc formed with a slot permits the use of a very simple structure because the angular movement of the coupling element. The use of a locking member consisting of a disc formed with a slot permits the use of a very simple structure because the angular movement of the coupling element can be limited by the ends of the slot. Because the slot is so disposed that the axis of rotation of the locking member coincides with the axis of the fixed axle when the locking member is in its locking position, unlocking is effected by a rotation of the locking member about the axis of the fixed axle so that a premature outward movement of the coupling element will be prevented and said outward movement will not be initiated until the corresponding stop carried by the coupling element is engaged by the locking member. The locking stop is desirably formed by that longitudinal edge of the slot of the locking member which is remote from the pivotal axis of the coupling element; in that case there is no need for a separate locking stop member.

Because the locking stop of the locking member is designed to prevent an outward movement of the coupling element, the locking stop should extend in the locking position in a direction which is as nearly as possible at right angles to the direction of that outward movement. For this purpose the angular movement of the locking member between its locking and non-locking positions may amount to at least 90°. In that case the locking stop consisting of the outer longitudinal edge of the slot in the locking member will have the desired orientation in the locking position. A larger angular movement of the locking member will be desirable if one end of the slot is centered on the axis of rotation of the locking member.

Figure 2:
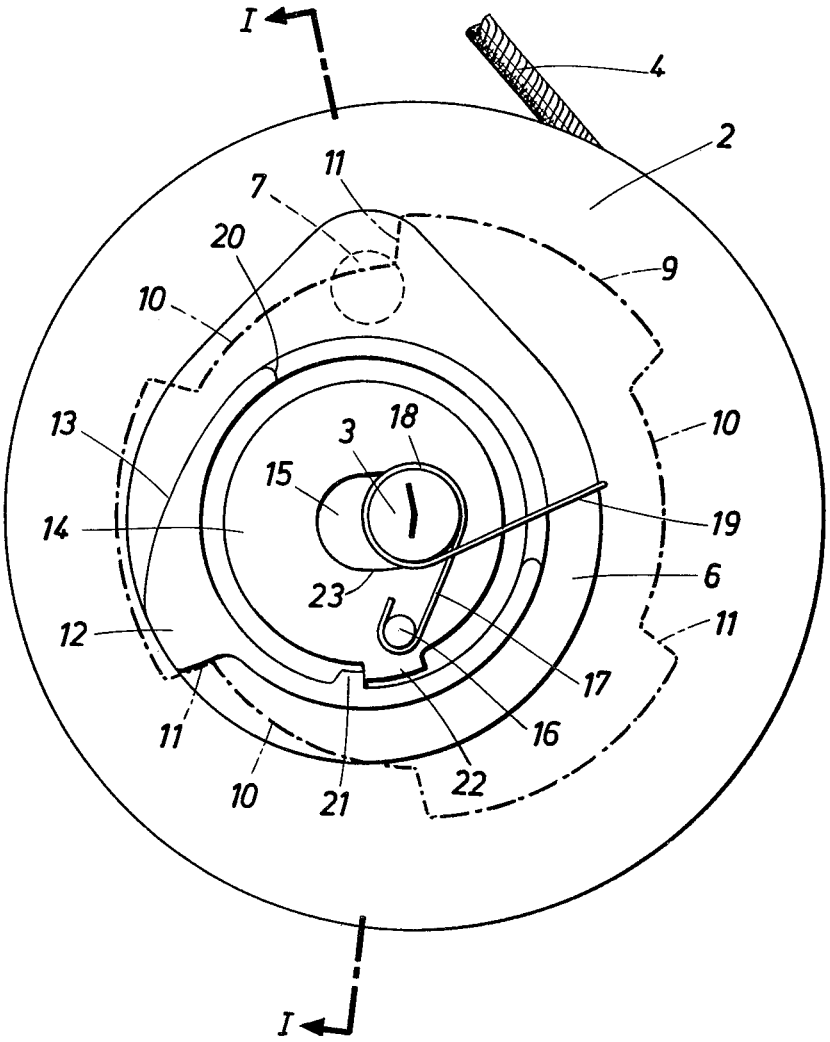
Figure 3:
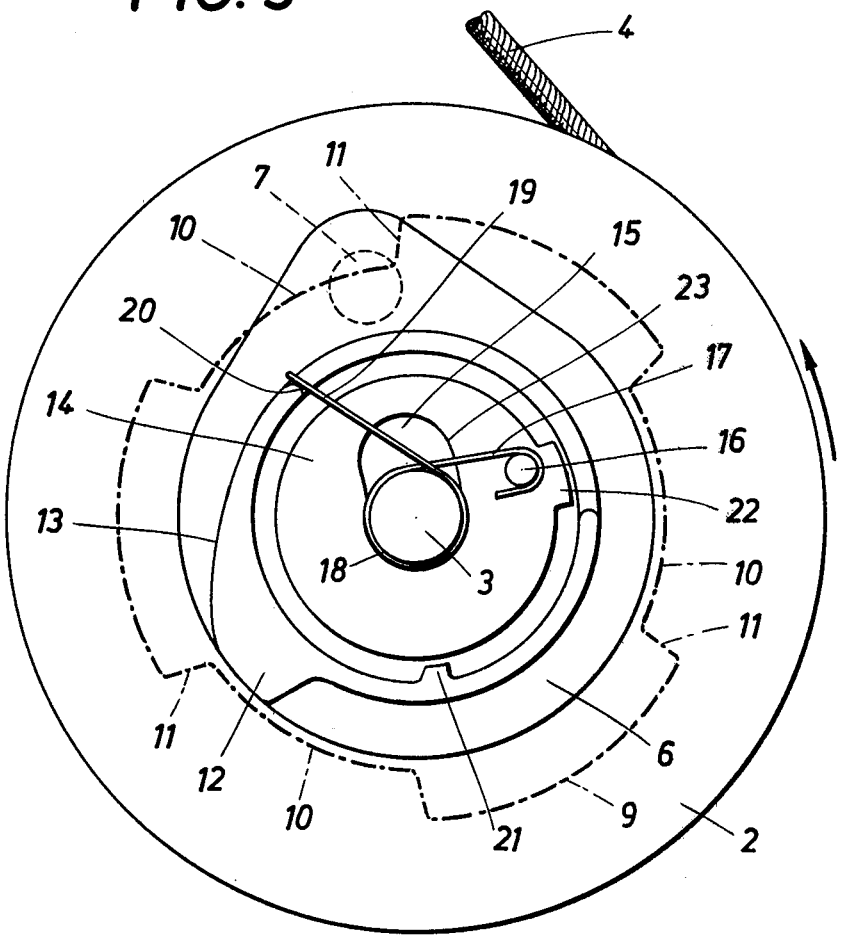

An embodiment of the invention is shown by way of example on the accompanying drawings, in which FIG. 1 is an axial sectional view taken on line I—I of FIG. 2 and showing a pullback starter embodying the invention, FIG. 2 is a top plan view showing the pullback starter with the coupling element swung out, and FIG. 3 is a view which is similar to FIG. 2 and shows the pullback starter with the coupling element swung in.

As is particularly apparent from FIG. 1, the pullback starter for an internal combustion engine comprises a frame or housing 1, which is adapted to be flanged to the internal combustion engine and in which a rope drum 2 is rotatably mounted on an axle 3, which is non-rotatably connected to the housing. A rope 4 is wound on the rope drum 2 and can be pulled from the latter to drive the rope drum 2 against the force of a pullback spring. When the withdrawn rope 4 is released, the spring 5 imparts a reverse rotation to the rope drum 2 so that the rope 4 is wound up on the drum 2.

A one-way coupling element 6 is eccentrically mounted on the rope drum 2 by means of a pivot pin 7, which is pivoted in a suitable bearing hole of the rope drum and defines a pivotal axis for the coupling element 6. The coupling element constitutes an engageable and disengageable clutch member, which cooperates with a cup-shaped second clutch member 9, which is non-rotatably connected to the input shaft 8 of the internal combustion engine. As is indicated in phantom in FIGS. 2 and 3, the clutch member 9 has inwardly protruding wall portions 10, which have side faces 11 that cooperate with an outwardly protruding nose 12 of the coupling element 6. When the coupling element 6 is swung out from its normal position shown in FIG. 3, to the engaging position shown in FIG. 2, the nose 12 of the coupling element 6 will engage one of the side faces 11 and will drive the input shaft 8 by means of the cup-shaped clutch member 9. When it is desired to disengage the clutch, the coupling element 6 must be pivotally moved in the opposite sense, in an inward direction. This will be automatically effected when the pullback spring 5 imparts a reverse rotation to the rope drum. Similarly, when the drive shaft 8 overruns the rope drum, the coupling element 6 will be swung in by the inwardly protruding wall portions 10 of the coupling member 9 when these wall portions engage the ramp formed by the back 13 of the nose 12.

A locking member 14 is rotatably mounted in the coupling element 6, which surrounds the fixed axle 3. The locking member 14 consists of a disc, which is formed with an arcuate slot 15, through which the fixed axle 3 extends. The locking member 14 has an axially protruding pin 16, which extends into a U-shaped protruding arm 17 of a prestressed coil spring 18, which is wound on the rigid axle 3. The second protruding arm 19 of the spring 18 cooperates with a stop 20, which is carried by the coupling element 6. The coil spring 18 controls the movement of the locking member 14 and by means of the free spring arm 19 limits the rotation of the locking member 14 relative to the coupling element 6 in one sense. The rotation of the locking member 14 relative to the coupling member 6 in the opposite sense is limited by a stop 21, which is carried by the coupling element and cooperates with a stop 22 carried by the locking member 14.

When the locking member 14 is in the stop-defined locking position shown in FIG. 2, the arcuate slot 15 of the locking member is centered on the axis of the pivot pin 7, i.e., on the pivotal axis of the coupling element, so that the coupling element 6 can be pivotally moved about the pin 7 in that position to an extent determined by the length of the slot 15. When the locking member 14 is in the other angular position, which is defined by the spring arm 19, the arcuate longitudinal center line of the slot 15 extends approximately along a radius with respect to the pivot pin 7 so that a pivotal movement of the coupling member 6 is prevented. It is apparent that the coupling element 6 can be locked and unlocked by an angular movement of the locking member 14 relative to the coupling element 6.

An angular movement relative to the coupling element 6 can be imparted to the locking member 14 by the coil spring 18, which restrains the locking member 14 between its two stop-defined positions relative to the coupling element 6 so that a rotation of the rope drum 2 will result in a relative rotation between the locking member 14 and the coupling element 6.

When the rope 4 is pulled to operate the pull-back starter, a pivotal movement in the sense indicated by the arrow shown in FIG. 3 is imparted to the rope drum 2. Because the coupling element 6 is connected by the pivot pin 7 to the rope drum 2 and the locking member 14 is connected by the coil spring 18 to the fixed axle 3, the coupling member 6 will perform an angular movement about the locking member 14 until the stop 21 carried by the coupling member 6 engages the stop 22 carried by the locking member relative to the coupling element does not result in a pivotal movement of the coupling element about the pin 7 because the axis of the pivotal connection between the locking member and the coupling element coincides with the axis of rotation of the drum 2, but said rotation causes the slot 15 to assume the angular position which is shown in FIG. 2 and in which the coupling element 6 can be swung out to engage the clutch. When the coupling element 6 has engaged the stop 22 carried by the locking member, a relative rotation between the locking member and the coupling element is no longer possible so that the coupling element 6 is now also restrained by the pin 16 under the action of the coil spring 18. Because the pin 7 revolves in unison with the rotating cable drum 2, this restraint results in an outward pivotal movement of the coupling element 6 until the fixed axle 3 engages the other end of the slot 15, as is shown in FIG. 2. Owing to this limitation of the pivotal movement of the coupling element 6, the pin 16, which has previously been restrained by the spring 18, begins to revolve in unison with the rotation of the rope drum 2 so that the coil spring 18 is also caused to revolve around the fixed axle 3 in unison with the rope drum 2. This rotation of the spring 18 is facilitated because the spring arm 17 is loaded in the spring-unwinding sense.

During the reverse rotation of the rope drum 2, the operations are performed in the reverse sequence. Being restrained by the spring 18, the pin 16 follows the reverse rotation of the rope drum 2 and initially imparts an inward pivotal movement to the coupling element 6 so that the nose 12 disengages the side faces 11 of the clutch member 9. As the reverse rotation of the rope drum 2 is continued, the locking member 14 disengages the stop 21 carried by the coupling element because the coupling element 6 is now free again to rotate in unison with the rope drum 2. The locking member 14 is restrained by the spring 18 until the stop 20 carried by the coupling element 6 engages the free spring arm 19 and the stop 20 then acts on the spring 18 in the unwinding sense so that the coupling element 6 acting on the spring 18 rotates the latter and the locking member 14 about the fixed axle 3. During that operation, the locking stop formed by one longitudinal edge 23 of the slot 15 extends approximately radially with respect to the axis of the pivot pin 7 and thus prevents a pivotal movement of the coupling member 6 about the axis of the pivot pin 7. As has been mentioned hereinbefore, the coupling element 6 can be unlocked in that the locking member 14 is rotated relative to the coupling element 6. Owing to the constraining action of the spring 18, this can be accomplished only during the actuation of the pullback starter. As is clearly apparent from FIG. 3, an unlocking would tend to move the spring in the winding-up sense if an attempt were made to rotate the locking member 14 in such a sense that its rotation is imparted to the spring, but such a load on the spring has a self-locking effect.

What is claimed is:

1. A pullback starter for an internal combustion engine having an input shaft, which is non-rotatably connected to a driven clutch member, said starter comprising a frame, an axle fixed in said frame, a rope drum rotatably mounted on said axle, a rope which is wound on said drum and adapted to be pulled from said drum so as to rotate the latter in a predetermined sense, a pullback spring tending to rotate said drum opposite to said predetermined sense, a one-way coupling element which is pivoted to said drum on a pivotal axis that is parallel to the axis of said axle, said coupling element carrying a first stop and being pivotally movable about said pivotal axis from an inner position to an outer position for one-way coupling engagement with said clutch member, and back to said inner position, a locking member which is movable relative to said axle and mounted in said coupling element for rotation relative thereto about an axis of rotation to a locking position, said locking member carrying a second stop which cooperates with said first stop to prevent an outward movement of said coupling element from said inner position to said outer position, and to a non-locking position of said locking member, in which said second stop is arranged to permit said movement and said locking member engages said coupling element in the sense of said outward movement, and a constraining spring, which extends around and is rotatable about said axle and torsionally prestressed to be normally in frictional contact with said axle and has at one end a spring arm, which protrudes laterally from said axle and engages said locking member, said constraining spring tending to move said locking member relative to said axle by means of said spring arm in the sense of said outward movement.

2. A pullback starter as set forth in claim 1, in which said frame is a housing which contains said axis, drum, pullback and constraining springs, coupling element and locking member.

3. A pullback starter as set forth in claim 1, in which said constraining spring is a coil spring and has at its opposite end a second spring arm and said coupling element carries a third stop, which is adapted to engage said second spring arm in a spring-unwinding sense and to define said locking position.

4. A pullback starter as set forth in claim 1, in which said locking member consists of a disc having a slot, through which said axle extends and which extends substantially along an arc of a circle that is concentric to said pivotal axis when said locking member is in said non-locking position, said slot has end portions engageable with said axle to define said inner and outer positions of said coupling element, and one of said end portions is centered on said axis of rotation.

5. A pullback starter as set forth in claim 1, in which said locking member is rotatable relative to said coupling element through at least 90°.

* * * * *